United States Patent [19]

Hamilton et al.

[11] Patent Number: 5,011,336

[45] Date of Patent: Apr. 30, 1991

[54] UNDERPINNING ANCHOR SYSTEM

[75] Inventors: Daniel Hamilton; Robert M. Hoyt, both of Centralia; Patricia J. Halferty, Columbia; J. Thomas Odom, Centralia, all of Mo.

[73] Assignee: A. B. Chance Company, Centralia, Mo.

[21] Appl. No.: 464,937

[22] Filed: Jan. 16, 1990

[51] Int. Cl.[5] ..... E02D 5/00

[52] U.S. Cl. ..... 405/230; 405/229

[58] Field of Search ..... 405/230, 229

[56] References Cited

U.S. PATENT DOCUMENTS

| | | | |
|---|---|---|---|
| 2,982,103 | 5/1961 | Revesz et al. | 405/230 |
| 3,786,641 | 1/1974 | Turzillo | 405/230 |
| 3,796,055 | 3/1974 | Mahony | 405/230 |
| 3,902,326 | 9/1975 | Langenbach, Jr. | 405/230 X |
| 4,070,867 | 1/1978 | Cassidy | 405/230 X |
| 4,634,319 | 1/1987 | May | 405/230 |
| 4,673,315 | 6/1987 | Shaw et al. | 405/230 |
| 4,678,373 | 7/1987 | Langenbach, Jr. | 405/230 |
| 4,695,203 | 9/1987 | Gregory | 405/230 |
| 4,708,528 | 11/1987 | Rippe | 405/230 |
| 4,765,777 | 8/1988 | Gregory | 405/230 |
| 4,854,782 | 8/1989 | May | 405/230 |
| 4,911,580 | 3/1990 | Gregory et al. | 405/230 |
| 4,925,345 | 5/1990 | McCown, Jr. et al. | 405/230 X |

*Primary Examiner*—Dennis L. Taylor
*Assistant Examiner*—J. Russell McBee
*Attorney, Agent, or Firm*—Hovey, Williams, Timmons & Collins

[57] ABSTRACT

A low-cost easy to install underpinning apparatus (14) for supporting below-grade structural footings such as foundations (10) or the like is provided which makes use of a power installed, load-bearing helix-type screw anchor (16) together with a connecting bracket assembly (18) secured to the foundation (10). The anchor (16) is screwed into the earth below the foundation (10), leaving the upright end of the anchor shaft (20) adjacent the foundation (10). The bracket assembly (18) advantageously includes a foundation-engaging plate (28) with a pair of spaced, outwardly extending wall portions (30, 32) rigidly secured thereto. An elongated, U-shaped bracket (36) together with a mating retainer (42) are releasably secured to the wall portions (30, 32) and serve to captively retain the upper end of the anchor shaft (20), with the U-bracket (36) having a top crosspiece wall (38) provided with a threaded opening (40) therethrough. A threaded, force-transmitting bolt (54) screwed into the bracket crosspiece (38) engages the uppermost butt end (22) of the anchor shaft (20) so that the anchor (16) becomes a load-bearing support for the foundation (10).

11 Claims, 2 Drawing Sheets

UNDERPINNING ANCHOR SYSTEM

BACKGROUND OF THE INVENTION

1. Field of the Invention

The present invention is broadly concerned with an improved anchor apparatus designed to support and resist settling of structural foundations or footings such as floors and the like. More particularly, it is concerned with such an anchoring apparatus and a corresponding method, wherein use is made of a power installed earth anchor driven adjacent a footing to be supported, together with a bracket assembly particularly suited for attachment to an exterior corner surface of the footing serving to couple the footing and anchor shaft so that the anchor becomes a load-bearing support for the footing.

2. Description of the Prior Art

Many homeowners face the disconcerting and oftentimes expensive problem of foundation settling. This phenomenon can arise by virtue of loose, sandy soil around the foundation, undue moisture conditions, expansive soils or improper original construction of the foundation. In any case, solving the settling problem and properly supporting the foundation (and usually the basement floor) is typically a very involved and costly proposition.

Various techniques have been proposed in the past for supporting below-grade structural footings. For example, U.S. Pat. No. 2,982,103 describes a system wherein a bracket is attached to basement walls, and a hole is bored through the adjacent floor. Elongated pipe sections are hydraulically driven downwardly through the floor until they can be driven no further or until a bearing region such as bedrock is reached, whereupon the pipe sections are coupled to the wallmounted bracket. Such systems are very costly to install. Additional patents describing various underpinning methods using hydraulic rams are described in U.S. Pat. Nos. 3,902,326, 3,796,055 and 4,765,777.

In addition, it has been known in the past to use embedded earth anchors as a means of supporting foundations or footings. For instance, anchors have been installed vertically beneath a footing, with plural anchors being interconnected with reinforced concrete. In other instances, plural anchors have been driven at various angles and tied together to the footing with reinforcing bars or hairpin connectors; such connection structure then being cast in concrete.

Despite these prior attempts, however, there is a distinct need in the art for an improved, easy to install system for providing load-bearing support for structural footings. Advantageously, such a system should be low in cost and readily installable from the outside of a house or other structure.

SUMMARY OF THE INVENTION

The present invention overcomes the problems outlined above and provides an underpinning method and apparatus making use of an embedded earth anchor presenting an upstanding anchor shaft, together with novel attachment bracket structure serving to operatively interconnect the anchor shaft and a structural footing in order that the anchor becomes a load-bearing support.

Broadly speaking, the method of the invention involves the steps of first excavating earth down to at least the level of the footing (and preferably somewhat lower) and for a distance away from the footing so as to provide working clearance. Next, one or more earth anchors each equipped with an elongated shaft presenting an earth-penetrating tip and a transversely extending load-bearing member (e.g., a helix section) is placed in the earth adjacent the footing; the anchor(s) are then rotated and screwed into the earth below the footing until the upper end of the shaft is adjacent the footing. Finally, the anchor shaft and footing are connected via an underpinning bracket assembly to establish the desired load-bearing relationship.

In this method, it is possible to install a foundation engaging plate of the bracket assembly prior to installation of each earth anchor in order that the plate serves as a guide for positioning the earth anchor during rotation of the elongated shaft thereof.

The preferred bracket assembly includes plate means adapted for securement to the structural footing at a below-grade location, together with attachment means including structure for receiving and captively retaining the upper end of the anchor shaft, such including structure defining a threaded opening adjacent the shaft. The plate means and shaft-retaining structure are operatively connected, and a threadably shiftable, force-transmitting bolt is placed within the threaded opening and rotated to engage the anchor shaft and establish the load-bearing relationship. Advantageously, the footing-engaging plate means is in the form of a somewhat L-shaped metallic plate adapted for footing securement by means of bolts, with a pair of outwardly extending, spaced apart walls rigidly secured to the L-shaped plate. These walls are preferably spaced by a distance sufficient to permit the walls to serve as a guide for orienting the elongated shaft of an earth anchor during installation thereof. The attachment means preferably includes an elongated, generally U-shaped bracket which, together with a mating wedge-shaped retainer, captively receives the upper end of the anchor shaft. The U-shaped bracket includes a top cross plate provided with a threaded aperture therethrough; the force-transmitting bolt is installed through this aperture, and engages the uppermost butt end of the anchor shaft.

DESCRIPTION OF THE PREFERRED EMBODIMENT

Figure 5:
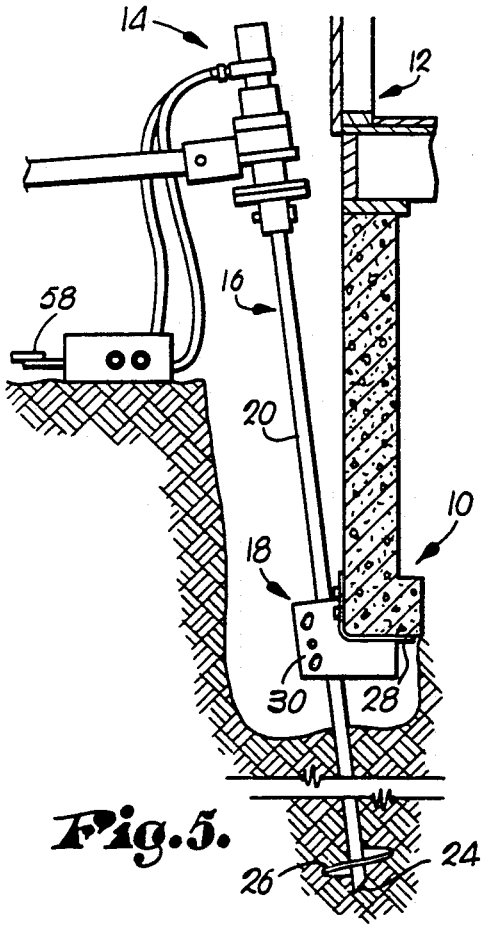
FIG. 5 is a sectional view illustrating the preferred manner of anchor installation in accordance with the invention.

Turning first to FIG. 5 of the drawing, it will be seen that the present invention contemplates a method and apparatus for supporting a below-grade structural footing such as the poured concrete floor/wall foundation 10 forming a part of a house 12 or other similar structure. In general, the invention makes use of a number of anchoring assemblies broadly referred to by the numeral 14, each including an elongated earth anchor 16, as well as a bracket assembly 18 serving to place the earth anchor, when embedded, in supporting, load-bearing relationship to the foundation 10.

In more detail, earth anchor 16 is of conventional design and includes an elongated metallic anchor shaft 20 which may have a square cross-sectional shape and presenting an uppermost butt end 22 (see FIG. 3) as well as an opposed, earth-penetrating tip 24. The anchor further includes a transversely extending load-bearing member, preferably a metallic helix section 26 secured to shaft 20 adjacent tip 24.

Figure 1:
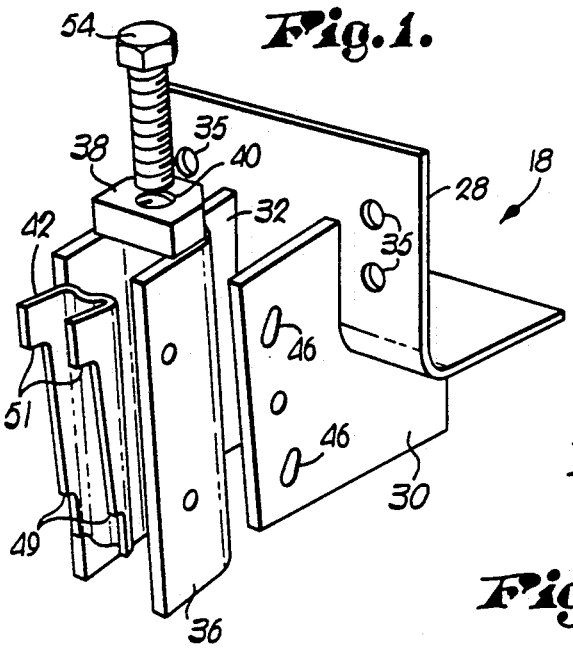
FIG. 1 is a perspective, exploded view of a bracket assembly in accordance with the invention.
Figure 2:
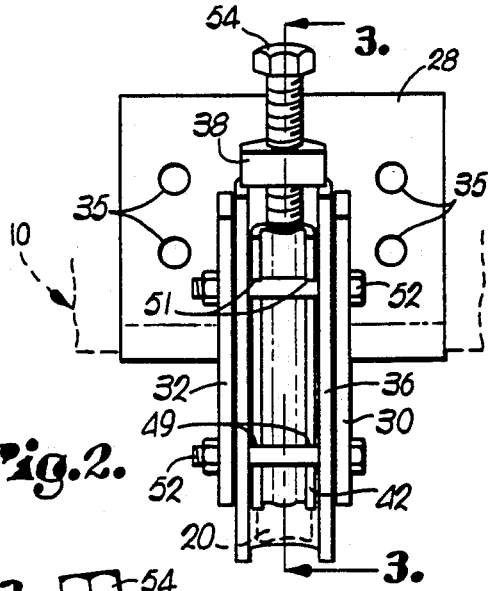
FIG. 2 is an elevation view of the bracket assembly of FIG. 1, shown as installed and operatively interconnected with the upper end of an anchor shaft (shown in phantom) captively retained by the assembly.
Figure 3:
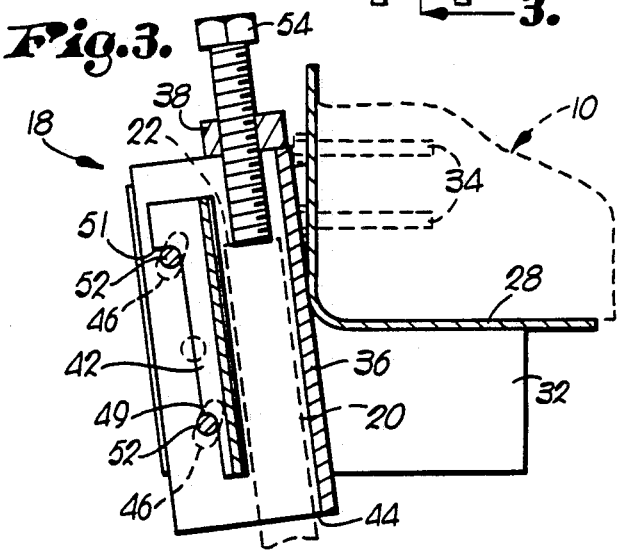
FIG. 3, is a sectional view taken along the line 3—3 of FIG. 2.

As shown in FIG. 1, the bracket assembly 18 includes an apertured, somewhat L-shaped foundation-engaging plate 28 having a pair of spaced apart, generally parallel, apertured walls 30, 32 secured to the convex face thereof. As best seen in FIGS. 2 and 3, plate 28 is adapted to mate with and engage a lower external edge of the foundation 10, and be permanently attached thereto by means of bolts 34 extending through oversized apertures 35 in the plate 28 and into the foundation material.

The assembly 18 further comprises a primary bracket 36 of elongated, generally U-shaped configuration and provided with a top cross plate 38. The latter includes a threaded opening 40 extending in the direction of the longitudinal axis of the shaft 20 when installed in the primary bracket 36. This threaded opening 40 is important for purposes to be described. A somewhat W-shaped, elongated retainer 42 is designed to nest within primary bracket 36 and to cooperatively define therewith an elongated, anchor shaft-receiving space 44.

Interconnection of the plates 30, 32, and the primary bracket 36 is afforded by means of corresponding apertures 46 and 48 provided in the plates 30, 32 and the primary bracket 36 respectively. The retainer is wedge shaped in the direction of the longitudinal axis thereof and includes steps 49, 51 that cooperatively mate with transverse bolts 52 extending through the apertures 46 and 48 to define the described shaft-receiving space 44.

A heavy-duty, force-transmitting bolt 54 also forms a part of the overall invention, and is designed to be threadably received within opening 40.

Figure 4:
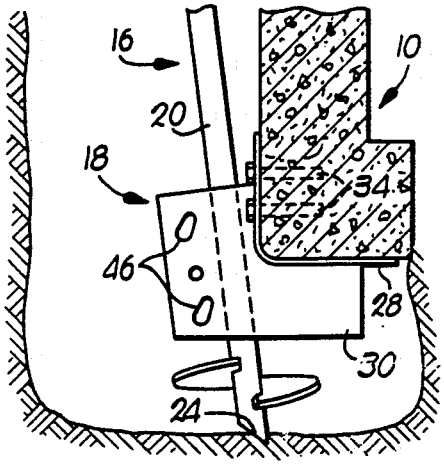
FIG. 4 is an elevation view showing the bracket assembly of the invention secured to a below-grade foundation, during the initial stages of anchor installation.

In the use of the anchoring assemblies 14, earth is excavated exteriorly of foundation 10 and down to at least the level of the footing region thereof. As shown in FIGS. 4 and 5, preferably the excavation is carried downwardly somewhat below the floor of the foundation. In any event, sufficient earth is excavated so as to provide adequate working clearance at the base of the foundation 10.

At this point, the soil beneath the foundation 10 is tested by conventional means so that the installer can properly calculate the number, spacing and depth of the assemblies 14 needed for properly supporting the foundation. Such calculations and considerations are entirely conventional and well within the skill of the art.

Next, the bracket assemblies 18 are secured to the foundation 10 as required, such involving first placing the plates 28 in engagement with the lower edge of foundation 10 after breaking out the footing so that the bracket is disposed directly beneath the foundation wall. This step is followed by securing the bracket assemblies to the foundation by means of bolts 34. Preferably, the apertures 35 are somewhat oversized relative to the bolts 34 so that, once installed, some minor settling of the plate 28 may occur without placing a shearing force on the bolts 34. Alternately, vertical slots could be formed in place of the oversized apertures 35 in order to take up any settling movement of the plate that might occur during installation of the assembly.

An anchor 16 is then installed below each plate 28, by first positioning tip 24 at the bottom of the excavation with shaft 20 extending upwardly between the plates 30, 32. In this regard, it is preferred to place the anchor at a slight angle with respect to the vertical (e.g., 5'-9') so that the load-bearing helix 26 of the anchor will be positioned directly beneath the foundation once installed. In any event, a conventional, hydraulically or electrically operated anchor wrench device 56 (see FIG. 5) is secured to the upper end of anchor shaft 20. Actuation of the device 56 by means of foot switch 58 serves to rotate the anchor and thus screw it into the earth.

When the anchor 16 is fully installed in the earth below foundation 10, the upper end of shaft 20 will be situated between the plates 30, 32. Any excess length of shaft extending above these plates can simply be removed by a cutting torch or other convenient means. Primary bracket 36 is then slipped over the uppermost end of shaft 20, and bolts 52 are used to interconnect the primary bracket 36 with the plates 30, 32 by passage of such bolts through the aligned apertures 46, 48.

Preferably, the apertures 46 are egg-shaped or slots such that the bolts 52 can be positioned through the lower ends of the apertures 46 when the primary bracket is initially secured to the plates 30, 32, and will work upward and slightly inward toward the L-shaped plate 28 when lifting pressure is applied to the top end 22 of the elongated shaft 20. This movement of the primary bracket between the plates 30, 32 serves to lock the bolts 52 in place. Further, by providing the enlarged apertures 46, it is easier to align the apertures 46, 48 when the primary bracket is initially positioned over the upper end of the shaft 20.

After the bolts 52 are installed, the retainer 42 is driven downward into the space defined between the bolts 52 and the shaft 20 until firmly wedged therebetween, thus improving the fit between the assembly 18 and the shaft 20. The W-shape of the retainer 42 serves to provide a good fit between the assembly 18 and shaft 20 regardless of the rotational orientation of the shaft 20 in the assembly. After wedging the retainer 42 into position, the bolts 52 are tightened to secure the components 36, 42 between the plates 30, 32 such that the bracket assembly 18 captively retains the uppermost end of shaft 20 within the space 44. It is not necessary that a frictional or mechanical connection be established between the assembly 18 and shaft 20.

Assembly 14 is completed by threading bolt 54 into aperture 40 and rotating the same until the end of the bolt engages butt end 22 of shaft 20, as shown in FIG. 3. As will be readily appreciated, continued rotation of the bolt 54 progressively transmits foundation loads to anchor 16 until the desired degree of foundation support is achieved. Such rotation of the bolt 54 is normally accomplished by means of an elongated, high mechanical advantage socket wrench. Typically, where a plurality of assemblies 14 are used, the respective bolts 54 thereof would be sequentially rotated in an incremental fashion until the desired degree of support is obtained.

During the initial stage of rotation of the bolt 54, some settling of the L-shaped plate 28 occurs which is permitted by the provision of the oversized apertures 46 therein. Further, upward and inward movement of the primary bracket 36 occurs relative to the plates 30, 32 due to the movement of the bracket 36 and bolts 52 in the slots or egg-shaped apertures 46. This movement, as mentioned, locks the bolts 52 in place and pulls the bracket inward toward the foundation slightly so as to remove slop from the assembly and provide a good fit between the assembly 18 and the shaft 20.

Further, as the elongated shaft moves downward relative to the primary bracket 36 during rotation of the bolt 54, the retainer 42 is pulled along such that the retainer becomes further wedged in place between the shaft 20 and the bolts 52. This is significant where a square cross-section shaft is employed since, depending on the orientation of the shaft in the space 44, the retainer must isolate the shaft 20 beneath the bolt 54.

Figure 6:
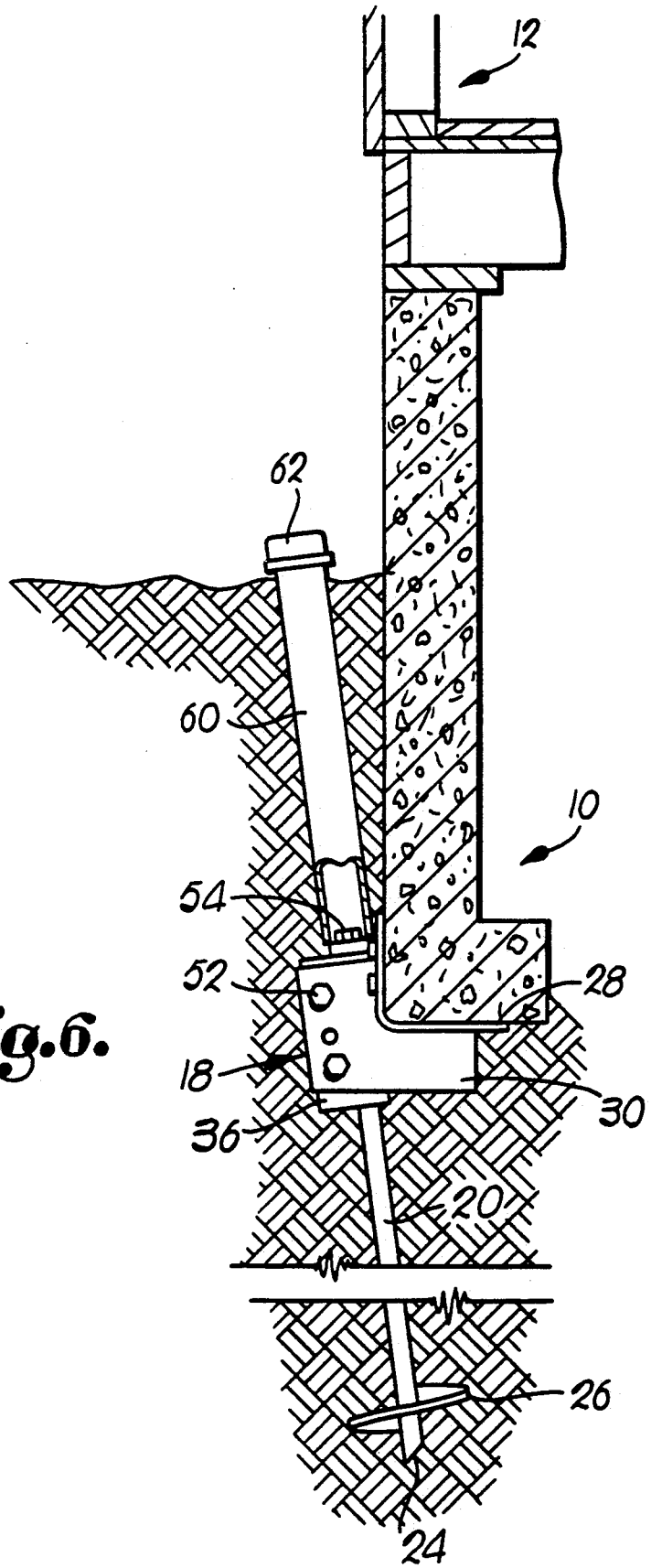
FIG. 6 is a sectional view illustrating the disposition of the bracket assembly and anchor shaft after installation thereof, with an access pipe shown extending between a force-transmitting bolt and an above ground opening.

After all of the foregoing operations have been completed, the excavated earth is replaced as shown in FIG. 6, and the bracket assembly 18 and anchor shaft 20 are left in place to provide support to the foundation and/or footing 10. If desired, a tube 60 can be positioned immediately over the force-transmitting bolt 54 before the excavated earth is replaced so that a hollow access opening is defined by the tube 60 which may be used at a later time to adjust the load carried by the anchor shaft.

The tube 60 extends to an above-ground position and includes a cap 62 that prevents dirt or foreign matter from getting into the tube 60.

When it is desired to adjust the load on the anchor shaft 20, the cap 62 is removed and a wrench (not shown) is inserted into the tube 60 to a position in which it engages the force-transmitting bolt 54. Thereafter, the wrench is turned to cause adjustment of the position of the bolt 54 relative to the bracket assembly 18.

By providing this feature of the invention, numerous advantageous results are realized. For example, by permitting subsequent adjustment of the load carried by each of the anchor shafts around a house, it is possible to accommodate settling of the earth beneath the foundation.

Although the invention has been described with reference to the preferred embodiment shown in the figures, it is noted that substitutions may be made and equivalents employed herein without departing from the scope of the invention as provided in the claims.

We claim:

1. An underpinning bracket assembly adapted for interconnecting a foundation, footing or the like with an embedded earth anchor presenting an upstanding anchor shaft whereby the anchor will support the footing, said bracket assembly comprising:

plate means;

means for securing said plate means to said footing at a below-grade location;

attachment means for operatively connecting said anchor shaft and plate means, including;

means for receiving and captively retaining said anchor shaft comprising structure defining a threaded opening adjacent the retained anchor shaft;

means connecting said shaft-retaining means and said plate means; and threadably shiftable, force-transmitting bolt means received within aid threaded opening for engaging said retained anchor shaft in order that said anchor becomes a load-bearing support for said footing;

said anchor shaft-retaining mans including an elongated, generally U-shaped bracket presenting an open lateral face with a top cross plate secured to the upper end thereof, said threaded opening being located through said top cross plate, and a retainer piece received within the open lateral face of said bracket.

2. The bracket assembly of claim 1, said plate means being generally L-shaped in cross-section for engaging a lower edge of said footing.

3. The bracket assembly of claim 1, wherein the retainer piece is wedge-shaped.

4. The bracket assembly of claim 1, said connecting means including a pair of wall portions rigidly secured to said plate means and extending outwardly therefrom, said anchor shaft-retaining means being received between said wall portions, there being securing means for releasably securing said anchor shaft-retaining means to said wall portions.

5. The bracket assembly of claim 4, wherein the wall portions are provided with opposing openings therethrough for receiving said securing means, the openings being slot-shaped to permit relative movement between the securing means and the walls when the bolt means is threadably shifted relative to the assembly.

6. The bracket assembly of claim 1, said opening-defining structure being located above the uppermost butt end of said anchor shaft, said bolt means engaging said butt end.

7. Apparatus for supporting a below-grade structural foundation, footing or the like, comprising:

an earth anchor including an elongated anchor shaft, and a transversely extending load-bearing member secured to said shaft, said anchor being adapted for embedding thereof in the earth below said footing with said anchor shaft extending upwardly to a point adjacent the footing; and an underpinning bracket assembly for interconnecting said anchor shaft and footing whereby the anchor will support the footing, said bracket assembly comprising:

plate means;

means for securing said plate means to said footing at a below-grade location and proximal to said anchor shaft;

means for receiving and captively retaining said anchor shaft including structure defining a threaded opening adjacent the retained anchor shaft;

means connecting said shaft-retaining mans and said plate mans; and threadably shiftable, force-transmitting bolt means received within said threaded opening for engaging said retained anchor shaft in order that said anchor becomes a load-bearing support for said footing;

said anchor shaft-retaining mans including an elongated, generally U-shaped bracket presenting an open lateral face with a top cross plate secured to the upper end thereof, said threaded opening being located through said top cross plate, and a retainer piece received within the open lateral face of said bracket.

8. Apparatus as set forth in claim 7, said plate means being generally L-shaped in cross-section for engaging a lower edge of said footing.

9. Apparatus as set forth in claim 7, said connecting means including a pair of wall portions rigidly secured to said plate means and extending outwardly therefrom, said anchor shaft-retaining means being received between said wall portions, there being means releasably securing said anchor shaft-retaining means to said wall portions.

10. Apparatus as set forth in claim 7, said opening-defining structure being located above the uppermost butt end of said anchor shaft, said bolt means engaging said butt end.

11. Apparatus as set forth in claim 7, said load-bearing member including a helix secured to said anchor shaft.

* * * * *